US006067905A

United States Patent [19]

Faber

[11] Patent Number: 6,067,905

[45] Date of Patent: May 30, 2000

[54] HAND STAMP WITH A SELF-INKING DEVICE

[75] Inventor: Ernst Faber, Wels, Austria

[73] Assignee: Colop Stempelerzeugung Skopek GmbH & Co. KG, Wels, Austria

[21] Appl. No.: 09/308,824

[22] PCT Filed: Jul. 30, 1998

[86] PCT No.: PCT/AT98/00182

§ 371 Date: May 25, 1999

§ 102(e) Date: May 25, 1999

[87] PCT Pub. No.: WO99/16624

PCT Pub. Date: Apr. 8, 1999

[30] Foreign Application Priority Data

Sep. 30, 1997 [AT] Austria ..... GM607/97

[51] Int. Cl.[7] ..... B41K 1/42

[52] U.S. Cl. ..... 101/334; 101/104; 101/405

[58] Field of Search ..... 101/103, 104, 101/105, 327, 333, 334, 405

[56] References Cited

U.S. PATENT DOCUMENTS

| | | | |
|---|---|---|---|
| 3,099,955 | 8/1963 | Keck | 101/105 |
| 3,783,786 | 1/1974 | Ellison et al. | 101/333 |
| 4,149,459 | 4/1979 | Flynn et al. | 101/103 |
| 4,432,281 | 2/1984 | Wall et al. | 101/334 |
| 4,823,696 | 4/1989 | Skopek | 101/334 |
| 5,152,223 | 10/1992 | Mairon | 101/104 |
| 5,623,875 | 4/1997 | Perets | 101/104 |
| 5,671,668 | 9/1997 | Shih | 101/104 |

FOREIGN PATENT DOCUMENTS

| | | |
|---|---|---|
| 384 999 | 2/1988 | Austria . |
| 19 06 426 | 11/1969 | Germany . |

*Primary Examiner*—John S. Hilten
*Assistant Examiner*—Leslie J. Grohusky
*Attorney, Agent, or Firm*—Collard & Roe, P.C.

[57] ABSTRACT

There is disclosed a hand stamp including a self-inking device and comprising an inverting mechanism (10) for a character unit, the inverting mechanism being arranged in a housing (1) and including an inverting axle (9), wherein the inverting axle (9) extends through slots (24) in the housing (1) and is mounted with its ends in legs (8) of an actuating bow (2) guided on the housing (1), the ends of the inverting axle (9) being secured against axial displacement by aid of safety elements; for a simple mounting and dismounting of the inverting axle (9) and its stable support in axial and radial direction, it is provided that at at least one leg (8) of the actuating bow (2), a shaped body (12) provided as safety element is capable of being snapped into a recess (11) of the leg (8), and that the inverting axle (9) is held partly in the leg (8) and partly on the shaped body (12).

9 Claims, 2 Drawing Sheets

HAND STAMP WITH A SELF-INKING DEVICE

FIELD OF THE INVENTION

The invention relates to a hand stamp including a self-inking device and comprising an inverting mechanism for a character unit, the inverting mechanism being arranged in a housing and including an inverting axle, which inverting axle, starting from the character unit, extends through slots in the housing and is mounted with its ends in legs of an actuating bow guided on the housing, the ends of the inverting axle being secured against axial displacement by aid of safety elements.

DESCRIPTION OF RELATED ART

In known hand stamps of this type, the ends of the inverting axle of the inverting mechanism are mounted either in blind bores or in bores of the actuating bow, cf., e.g., AT 384 999 B (=U.S. Pat. No. 4,823,696 A), U.S. Pat. No. 3 783 786 A or U.S. Pat. No. 4,432,281 A, wherein commonly safety elements, such as Seeger circlip rings, rivets etc. are used for axially securing the inverting axle. Mounting and dismounting, respectively, of these safety elements is, however, comparatively time-consuming. Since in case of mounting the inverting axle in blind bores, the legs of the actuating bow may bend and thus the inverting axle may "snap out" of the blind bores, also there such safety elements, as mentioned, are utilized.

SUMMARY OF THE INVENTION

The invention has as an object to provide a hand stamp of the initially defined kind whose inverting axle can be mounted and dismounted in a quick and simple manner by simple means, and the stable mounting of which, both in radial and in axial direction, is to be ensured also if handled improperly.

According to the invention, this object is achieved in that at at least one leg of the actuating bow, a shaped body provided as safety element is capable of being snapped into a recess of the leg, and that the inverting axle is supported partly in the leg and partly on the shaped body and thus is secured against axial displacement. By this design, the above-mentioned object can well be met. The shaped body serving as safety element can be produced at low cost from synthetic material, and during mounting of the inverting axle, after insertion of the latter it can simply be pushed in and fixed by snapping in, i.e. both manually and also by means of a machine.

According to a preferred embodiment of the invention it is provided that the inverting axle at each of its ends includes a peripheral groove and in the portion of the peripheral groove is radially and axially held in a lower bearing shell which is formed in the region of the recess of the leg of the actuating bow, whereas a portion of the inverting axle adjacent the peripheral groove radially abuts on a projection of the shaped body. In the assembled state, thus the stable position of the inverting axle is ensured both in radial and also in axial direction by mutual locking of the shaped body, the leg of the actuating bow and the inverting axle, in a particularly simple and efficient manner so that the inverting axle then cannot be inadventently displaced, neither axially nor laterally. For supporting the inverting axle upwardly over a surface area it is suitable if the projection of the shaped body forms an upper bearing shell for radial journaling of the inverting axle. It may also advantageously be provided that the projection of the shaped body forming the upper bearing shell is designed to be finger-shaped. In this instance, the fingershaped projection acts like a locking bar for the inverting axle. Furthermore, the finger-shaped projection preferably is guided in the slot of the housing. By this, an additional longitudinal guide is formed for the actuating bow, and simultaneously also the radial contact area for the inverting axle toward the upper side is enlarged.

It is also advantageous if at least a portion of the axle located adjacent the peripheral groove is radially journaled in a bearing shell additionally formed in the leg of the actuating bow. In this manner, an additional radial contact area for the inverting axle towards the bottom side is achieved.

A preferred embodiment of the snap connection between the shaped part and the actuating bow is characterized in that the shaped body has knobs capable of being snapped into depressions formed in the edge of the recess of the leg. Here it is, furthermore, advantageous if the shaped body has longitudinal slots for an elastic deformation of the shaped body when being snapped into the recess.

For an easy mounting and dismounting of the shaped part it is also suitable if the recess on the leg is formed to be downwardly open.

BRIEF DESCRIPTION OF THE DRAWINGS

The invention will now be explained in more detail by way of a preferred exemplary embodiment to which, however, it shall not be restricted.

DETAILED DESCRIPTION OF THE PREFERRED EMBODIMENT

Figure 1:
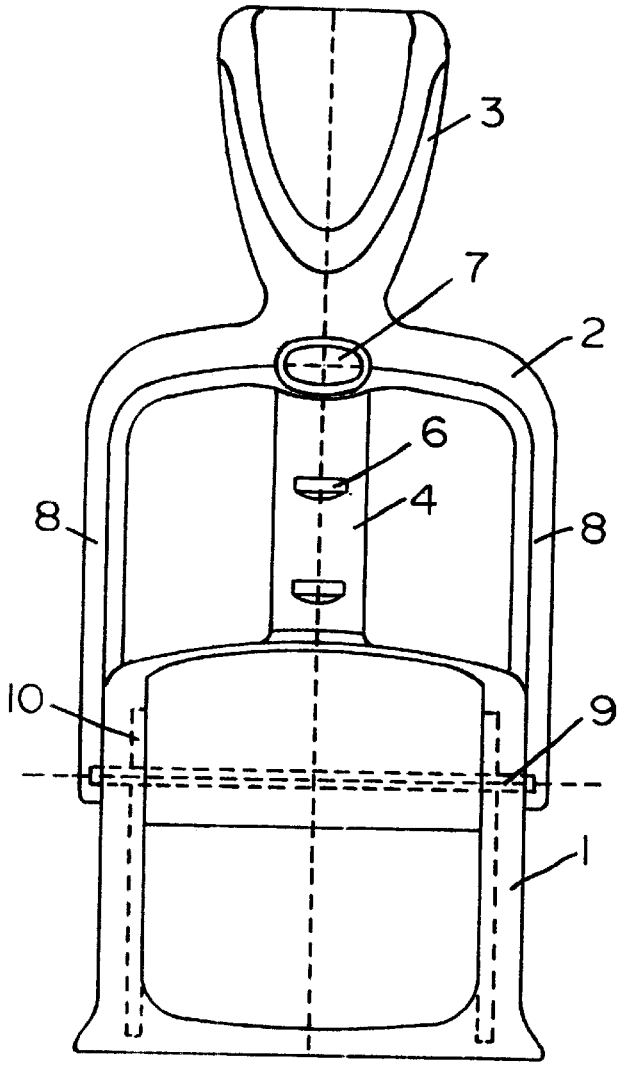
FIG. 1 shows a hand stamp including an axle bearing according to the invention in front view.
Figure 2:
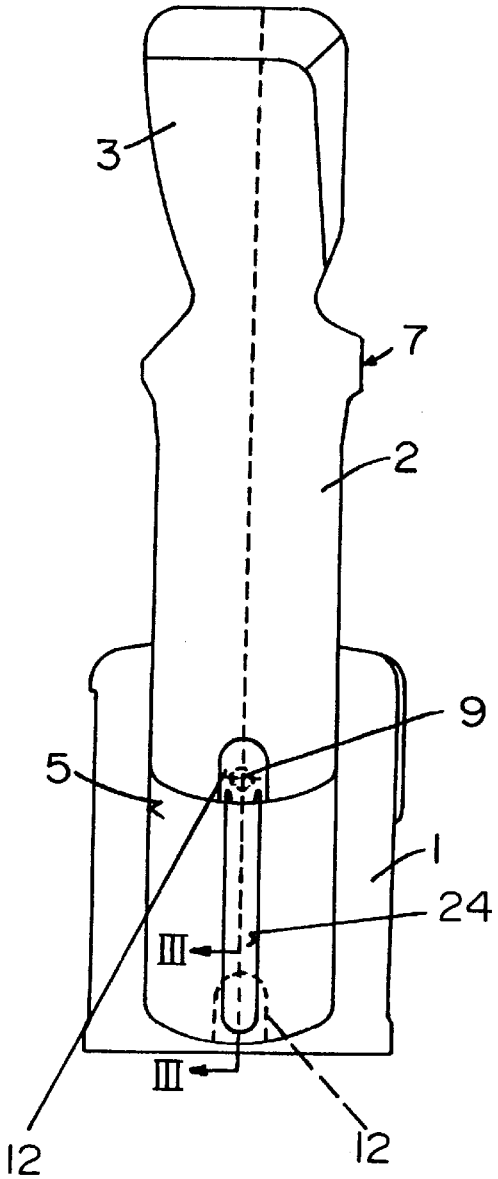
FIG. 2 shows the stamp according to FIG. 1 in side view, wherein also the lower or actuating position of the actuating bow is illustrated in broken lines.

The hand stamp illustrated in FIGS. 1 and 2 comprises a housing 1 in a per se conventional manner, on which an actuating bow 2 having a handle 3 is guided, on the one hand, on a sleeve 4 moulded to the housing 1 and in which a spring (not illustrated) urging the actuating bow upwards is inserted, and, on the other hand, in lateral recesses 5 of the housing 1. The sleeve 4 has notches 6 in which a latching knob 7 can latch in.

At the ends of the legs 8 of the actuating bow 2, an inverting axle 9 of an inverting mechanism 10 merely schematically indicated is mounted, the structure of the inverting mechanism being known and thus not requiring any further explanation. What is essential in this case is only that when the actuating bow 2 is moved downwards relative to the housing 1, inversion, i.e. pivoting by 180°, of a character unit not illustrated in detail in FIGS. 1 and 2 is brought about via the inverting axle 9.

Figures 3, 4, 5:
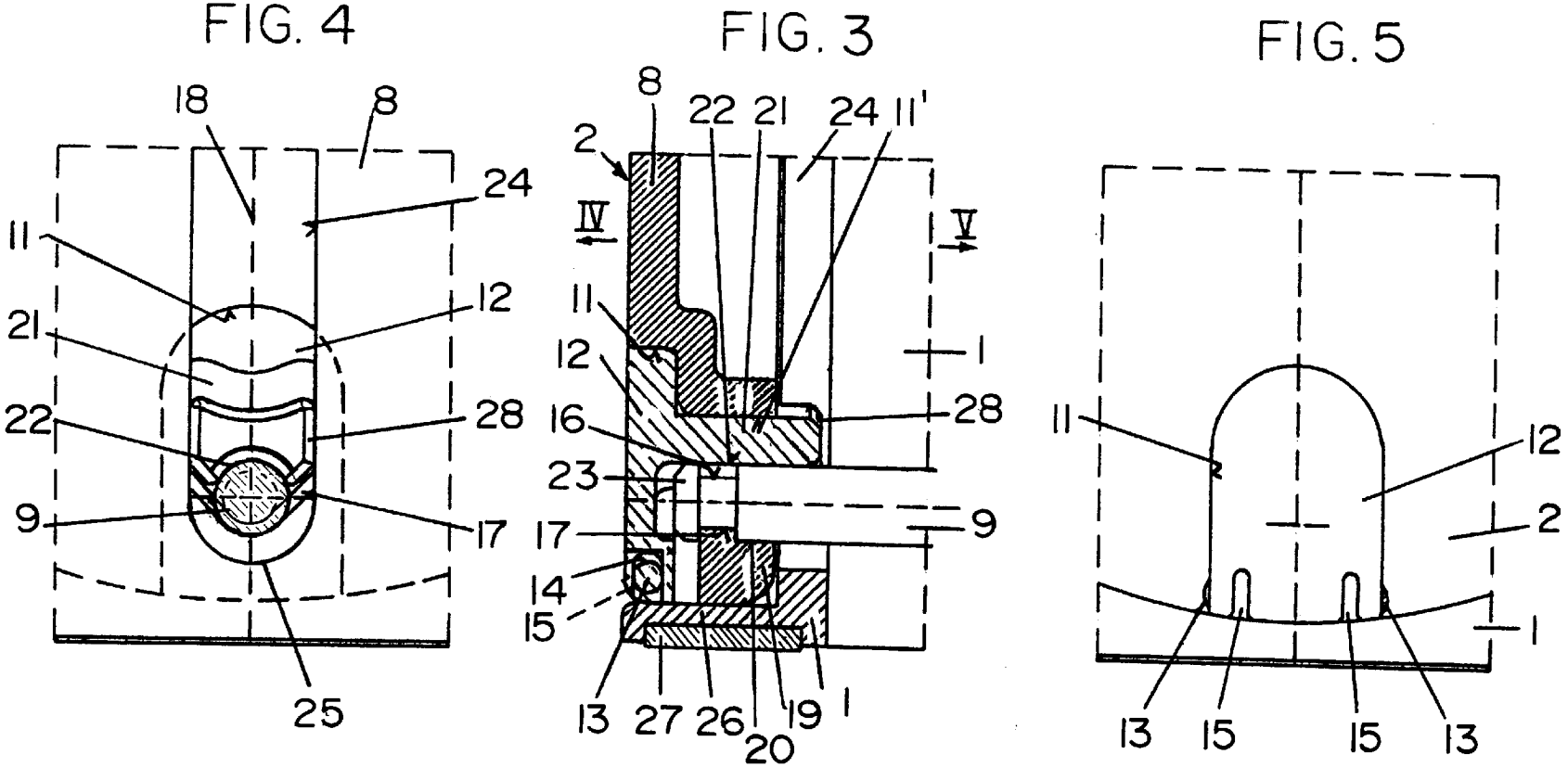
FIG. 3 shows a longitudinal section of the axle bearing on an enlarged scale, generally along the line III—III of FIG. 2, with the actuating bow in its lower printing position, cf. also the shaped part shown in hatching.
FIG. 4 is a side view of the axle bearing in the direction of arrow IV of FIG. 3.
FIG. 5 shows a side view of the axle bearing in the direction of arrow V of FIG. 3.

As is apparent from FIGS. 3 to 5, the actuating bow 2 comprises a downwardly open recess 11 at the ends of its legs 8, into which recess a shaped body 12 is inserted or snapped in, respectively. For this purpose, knobs 13 (cf. FIG. 5) are laterally moulded to the shaped body 12 which are capable of being snapped in latching depressions 14 formed in the edge of the recess 11. For mounting or dismounting of the shaped body 12 under elastic deformation of the same, longitudinal slots 15 are provided in the region of the knobs 13 which are open towards the lower side of the shaped body 12.

The inverting axle 9 of the inverting mechanism 10 has a peripheral groove 16 on each end. In the portion of the peripheral groove 16, the axle 9 downwardly is mounted in a bearing shell 17 which is adapted to the diameter and the width of the peripheral groove 16 and formed at the end of the leg 8 of the actuating bow 2. In detail, the bearing shell 17, starting from the longitudinal axis 18 of the actuating bow 2, extends circularly over a central angle of approximately±45° and subsequently changes along a straight line into an inclined portion having an inclination of e.g. approximately 45° relative to the longitudinal axis 18, whereby V-shaped rim zones of the lower bearing shell 17 are formed. The bearing shell 17 thus projects upwardly nose-like so as to engage in the peripheral groove 16. Thus, the inverting axle 9 in the portion of its peripheral groove 16 downwardly is supported over an angle of approximately 90° in radial direction and over an angle of approximately 180° in axial direction. The portion of the inverting axle 9 located adjacent the peripheral groove 16 in the direction towards the interior of the stamp additionally is downwardly mounted in a bearing shell 20 (cf. FIG. 3) formed in a projection 19 of the actuating bow 2, likewise over an angle of 90° in radial direction.

Upwardly, the inverting axle 9 is mounted in a bearing shell 22 formed in a flat-finger-shaped projection 21 of the shaped body 12, the bearing shell 22, starting from the longitudinal middle axis 18 of the stamp, extending circular-arc-shaped over a central angle of approximately ±75° and subsequently changing along a straight line into an inclined region leading away from the inverting axle 9 and having an inclination of 45° relative to the longitudinal axis 18, which is each located parallelly to and slightly spaced from the above-mentioned inclined region of the lower bearing shell 17. Thus, the inverting axle 9 including its axle head 23 following upon the peripheral groove 16 is upwardly held over an angle of aproximately 150° as well as supported in radial direction.

The projection 21 is inserted in a stepped portion 11' of the recess 11 and extends in axial direction beyond the inner side of the projection 19 of the actuating bow 2 so as to be guided in a longitudinal slot 24 of the housing 1, through which also the inverting axle 9 is guided. This provides an additional longitudinal guide for the actuating bow 2 on the housing 1. If such an additional guide is not desired, the projection 21 may already terminate at the inner side of the projection 19 of the leg 8 (or in front thereof), i.e. as compared to the illustration shown in FIG. 3, it may be correspondingly shorter.

The longitudinal slot 24 in the housing 1 is downwardly semi-circularly closed at 25 (cf. FIG. 4); yet, optionally, the longitudinal slot 24 may also be designed to be downwardly open.

At the pedestal or contacting frame 26 of the housing 1, e.g. an antislipping device 27 of rubber or the like is attached (cf. FIG. 3).

Mounting of the inverting axle 9 is effected such that it is inserted with its peripheral groove 16 into the lower bearing shell 17, "centering" being effected during insertion thereof by the V-shaped rim zones of the lower bearing shell 17. Subsequently, the shaped body 12 is pushed into the recess 11 and snapped in. Pushing in of the shaped body 12 is facilitated by the fact that the front-side rim of the projection 21 of the shaped body 12 is provided with a chamfer 28.

What is claimed is:

1. A hand stamp including a self-inking device and comprising (a) a housing defining slots, (b) a character unit, (c) an inverting mechanism for the character unit, the inverting mechanism being arranged in the housing and including (1) an inverting axle, starting from the character unit, extending through the slots in the housing, (d) an actuating bow having legs guided on the housing, (1) the inverting axle having ends mounted in the legs, and (e) a shaped body at at least one of the legs of the actuating bow for providing a safety element securing at least one of the ends of the inverting axle against axial displacement, the shaped body being capable of being snapped into a recess of the leg, and the inverting axle being supported partly in the leg and partly on the shaped body.

2. The hand stamp of claim 1, wherein the shaped body has knobs capable of being snapped into depressions in an edge of the recess in the leg of the actuating bow.

3. The hand stamp of claim 1, wherein the shaped body has longitudinal slots permitting the shaped body to be elastically deformed when snapped into the recess.

4. The hand stamp of claim 1, wherein the recess is downwardly open.

5. The hand stamp of claim 1, further comprising a bearing shell arranged in the recess of the leg, the end of the inverting axle defining a peripheral groove, a lower portion of the inverting axle at the peripheral groove being held radially and axially in the bearing shell, and the shaped body including a projection, an upper portion of the inverting axle adjacent the peripheral groove abutting the projection.

6. The hand stamp of claim 5, wherein the projection of the shaped body forms an upper bearing shell for radially journaling the inverting axle.

7. The hand stamp of claim 6, wherein the projection of the shaped body is finger-shaped.

8. The hand stamp of claim 7, wherein the finger-shaped projection of the shaped body is guided in the slot in the housing.

9. The hand stamp of claim 5, comprising a further bearing shell arranged in the recess of the leg, a lower portion of the inverting axle adjacent the peripheral groove being radially journaled in the further bearing shell.

* * * * *